US006230426B1

(12) United States Patent
Fakhoury et al.

(10) Patent No.: US 6,230,426 B1
(45) Date of Patent: May 15, 2001

(54) ACCESS PANEL FOR A VENDING MACHINE FACE

(75) Inventors: Bassam Hassan Fakhoury; Crystal Gaye Burdette, both of Marietta, GA (US); Justin L. Westfahl, Mississauga, CA (US)

(73) Assignee: The Cola-Cola Company, Atlanta, GA (US)

( * ) Notice: Subject to any disclaimer, the term of this patent is extended or adjusted under 35 U.S.C. 154(b) by 0 days.

(21) Appl. No.: 09/100,096

(22) Filed: Jun. 19, 1998

Related U.S. Application Data

(63) Continuation-in-part of application No. 08/845,376, filed on Apr. 24, 1997, now Pat. No. 5,956,876.

(51) Int. Cl.[7] ..... G09F 7/02

(52) U.S. Cl. ..... 40/611; 24/542; 49/168; 49/394

(58) Field of Search ..... 40/611, 617, 658; 248/220.22, 221.11, 223.41; 24/542, 543, 295, 458; 312/205; 49/168, 169, 170, 394, 503, 67; 70/16, 18, 19

(56) References Cited

U.S. PATENT DOCUMENTS

| | | | |
|---|---|---|---|
| 3,803,738 | 4/1974 | Weiss | 40/306 |
| 4,326,620 | 4/1982 | Felix et al. . | |
| 4,516,343 | 5/1985 | Stilling | 40/574 |
| 4,940,160 | 7/1990 | Williams . | |
| 5,255,968 | 10/1993 | Craven . | |
| 5,465,774 | 11/1995 | Smith | 160/90 |
| 5,471,794 | 12/1995 | Nishioka . | |
| 5,488,656 | 1/1996 | DeArkland . | |
| 5,505,333 | 4/1996 | Shibazaki et al. . | |
| 5,509,225 | 4/1996 | Minh et al. | 40/611 |
| 5,598,655 | 2/1997 | McGarrah | 40/611 |
| 5,680,721 | 10/1997 | Hine, Jr. | 40/611 |

*Primary Examiner*—Joanne Silbermann
(74) *Attorney, Agent, or Firm*—Finnegan, Henderson, Farabow, Garrett & Dunner, L.L.P

(57) ABSTRACT

A vending machine includes a vending machine face having an access panel therein for providing access to a graphics piece in the vending machine face. The access panel is movable from a closed position prohibiting access to the graphics piece, to an open position permitting access to the graphics piece for removal of the graphics piece. The access panel allows a person to change the graphics piece without opening the vending machine door. A locking mechanism is provided for locking the access panel in the closed position. The access panel is openable by using a special key or tool which is different from the key used to open the vending machine door. This allows the vending machine owner to give someone the task of changing the graphics piece without having to worry about the security of the money inside the vault area by giving that person only the special key to the access panel instead of a key to the vending machine door. Without the special key, the graphics piece is securely held in the vending machine face to prevent theft of the graphics piece. The access panel may be incorporated into the exterior trim of the face, such as the upper trim piece.

28 Claims, 16 Drawing Sheets

ACCESS PANEL FOR A VENDING MACHINE FACE

This application is a continuation-in-part of application Ser. No. 08/845,376, now U.S. Pat. No. 5,956,876, filed on Apr. 24, 1997, the entire contents of which are hereby incorporated by reference.

FIELD OF THE INVENTION

The present invention relates to a vending machine face having an access panel therein for providing access to a graphics piece in the vending machine face. The access panel allows a person to change the graphics piece without opening the vending machine door.

DESCRIPTION OF THE BACKGROUND ART

With today's vending machines, one or more graphics pieces are provided in a particular arrangement to form the face of the vending machine. These graphics pieces may be designed to attract attention to the vending machine, or may be utilized to promote a particular item. These graphics pieces may become damaged over time, or the item being promoted may change. Thus, it becomes necessary to change one or more of the graphics pieces in order to change the appearance of the vending machine.

In order to prevent theft of the graphics pieces in existing vending machines, the faces of the vending machines are designed so that the graphics pieces are not readily removable from the exterior of the machine. Therefore, it is necessary to open the vending machine door in order to obtain access to the interior of the door for the purpose of changing one or more of the graphics pieces from the inside of the door. Thus, the interior contents of the vending machine are accessible to the person changing the graphics piece, including the vault containing money therein. Accordingly, only certain trusted people can be authorized to perform the task of changing the graphics pieces because of security issues with respect to the contents of the vending machine.

There is a need in the art for a vending machine having a face including at least one graphics piece, whereby the graphics piece may be changed without opening the vending machine door. This would allow the owner of the vending machine to give someone the task of changing the graphics piece without having to worry about the security of the money inside the vault area by giving that person access only to the graphics piece instead of a key to the vending machine door.

SUMMARY OF THE INVENTION

Accordingly, it is the primary object of the present invention to provide a vending machine face having an access panel therein for providing access to a graphics piece in the vending machine face.

It is a further object of the present invention to provide a vending machine face having an access panel therein which allows a person to change the graphics piece without opening the vending machine door.

Yet another object of the present invention is to provide a vending machine in which someone may perform the task of changing the graphics piece without having access to the interior contents of the vending machine.

Still another object of the present invention is to provide a vending machine having increased security for any money located inside the vault area of the vending machine.

These and other objects of the present invention are fulfilled by providing a vending machine having an access panel located in the face for providing access to a graphics piece in the vending machine face. The access panel allows a person to change the graphics piece without opening the vending machine door. The access panel may be incorporated into the exterior trim of the face. The access panel is openable by using a special key or tool which is different from the key used to open the vending machine door. This allows the owner to give someone the task of changing the graphics piece without having to worry about the security of the money inside the vault area by giving that person only the special key to the access panel instead of a key to the vending machine door. Without the special key, the graphics piece would be securely held in the vending machine face to prevent theft of the graphics piece.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
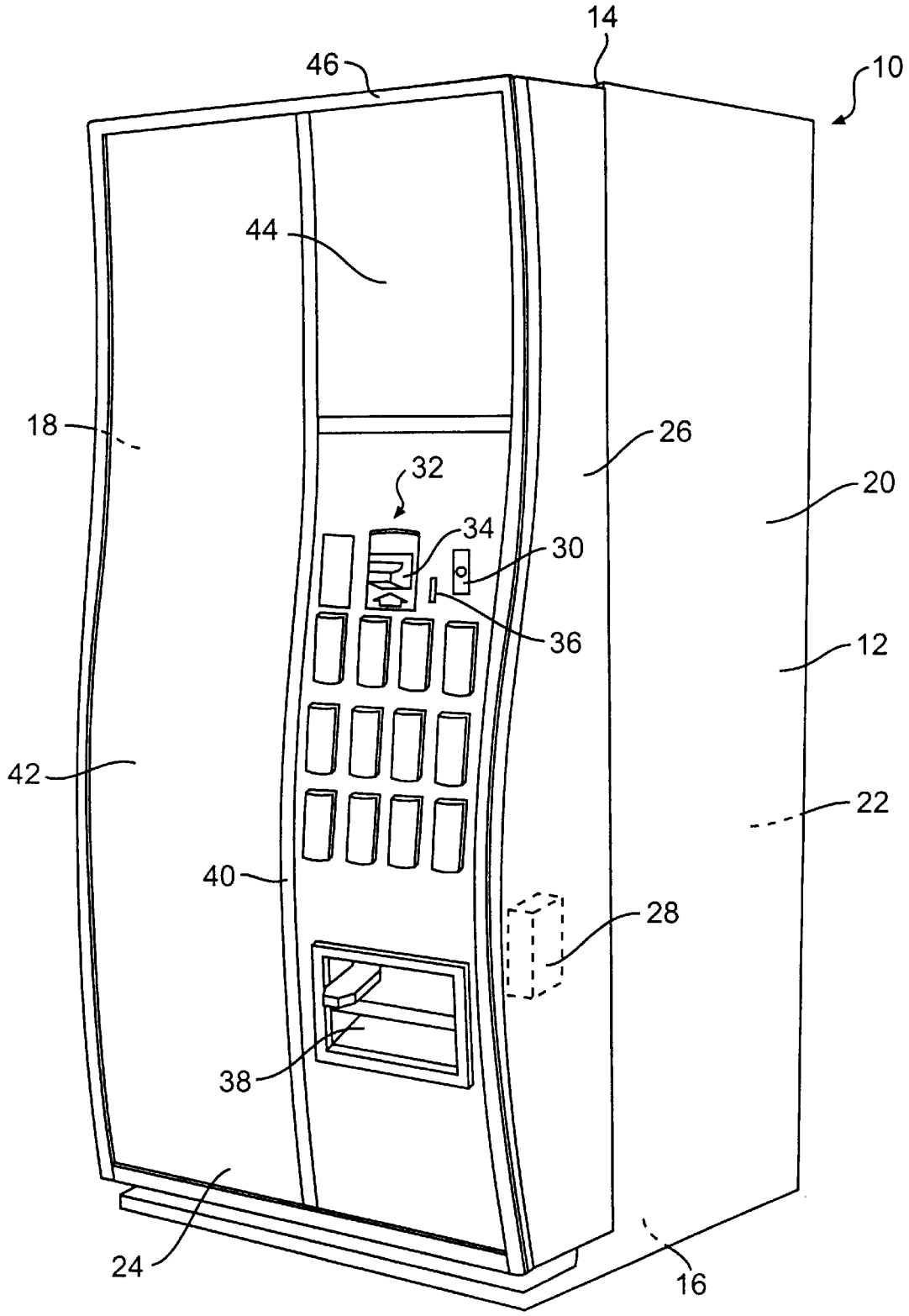
FIG. 1 is a perspective view of a vending machine which may incorporate an access panel of the present invention.

As used herein, like reference numerals have been used to designate similar components throughout the various embodiments.

Referring in detail to the drawings and with particular reference to FIG. 1, a first embodiment of the vending machine 10 is shown. The vending machine 10 includes a cabinet 12 with a rectangular top wall 14, a bottom wall 16, opposing right and left side walls 18, 20, a back wall 22, and a front face 24. The front face 24 of the vending machine 10 shown in FIG. 1 forms a door 26 which is pivotally attached to the cabinet 12 at the left side thereof. The door 26 is movable between a closed position where access to the interior contents of the vending machine 10 is prohibited, and an open position which provides access to the interior of the vending machine 10. When the door 26 is open, a service person may restock the vending machine 10 with articles to be dispensed, such as beverage cans. Further, the service person may access the money box 28 or perform repair work on the vending machine 10.

A lock 30 is provided on the vending machine door 26 to lock the door to the cabinet 12 in a closed position. When the door 26 is locked in the closed position, access to the money box 28 and the interior of the machine is prohibited. The door 26 further contains a transaction area 32 which may include a bill validator 34 and a coin slot 36. The door 26 further includes a delivery port 38 near the bottom of the door 26 which provides a discharge opening from the vending machine 10. Beverages or other items can easily be dispensed through the delivery port 38. The height of this port 38 and its position on the door 26 of the vending machine 10 can be varied. For example, the delivery port 38 can be located closer to the top or bottom of the door 26 or could be located in the center part or on the left side of the door 26.

It should be understood that while the first embodiment shows the door 26 as forming the front face 24, with the door 26 including the above-described elements, these elements of the face 24 of the vending machine 10 may be formed on a portion of the vending machine 10 other than the door 26. Further, the door 26 does not necessarily form the front face 24 of the vending machine 10. For example, the door 26 may be formed as part of one of the side walls 18, 20 or the rear wall 22 of the vending machine 10.

The face 24 of the vending machine 10 includes a central column 40 and a plurality of graphics pieces 42, 44. The graphics pieces 42, 44 may be illuminated from behind, and may include product identifying indicia thereon. The embodiment of FIG. 1 shows a first larger graphics piece 42 located on the left side of the face 24 of the vending machine 10, and a second smaller graphics piece 44 located in the upper right portion of the face 24 of the vending machine 10. The vending machine 10 of the first embodiment shown in FIG. 1 has a contoured or undulating face 24. However, vending faces which are generally flat or have other curved configurations may be utilized with the present invention.

Figure 2:
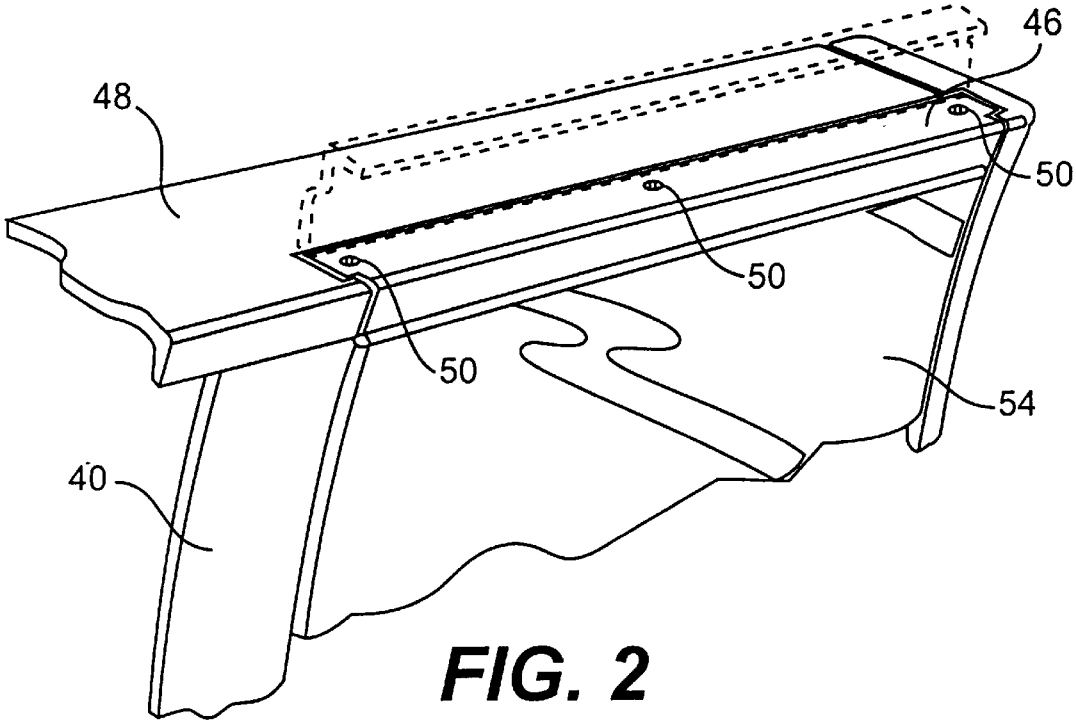
FIG. 2 is a partial perspective view of the vending machine of the present invention showing the access panel in a top trim piece.

Turning now to FIG. 2, a first embodiment of an access panel 46 is shown for providing access to the graphics piece 44 for purposes of changing the graphics piece 44. While the following discussion specifically refers to the graphics piece 44, it is to be understood that the same discussion would apply to the graphics piece 42, or any graphics piece located in or on the face 24 of the vending machine 10.

The access panel 46 is provided in the vending machine face 24, and is movable from a closed position prohibiting access to the graphics piece 44, to an open position permitting access to the graphics piece 44 in order to remove the graphics piece 44. As shown in FIG. 2, the access panel 46 is located in the upper exterior trim piece 48 of the face 24. When the access panel 46 is in a closed position shown in solid lines, a plurality of locking fasteners 50 are provided to secure the access panel 46 in the closed position. The locking fasteners 50 may comprise a plurality of screws having an odd-shaped aperture therein such that only insertion of an appropriately shaped tool or key will permit the locking fasteners 50 to be removed. Alternatively, the locking fasteners 50 may comprise locks similar to the embodiment shown in FIG. 16, which will be discussed in more detail later. While three locking fasteners 50 are shown, any number of fasteners 50 could be used.

Figure 3:
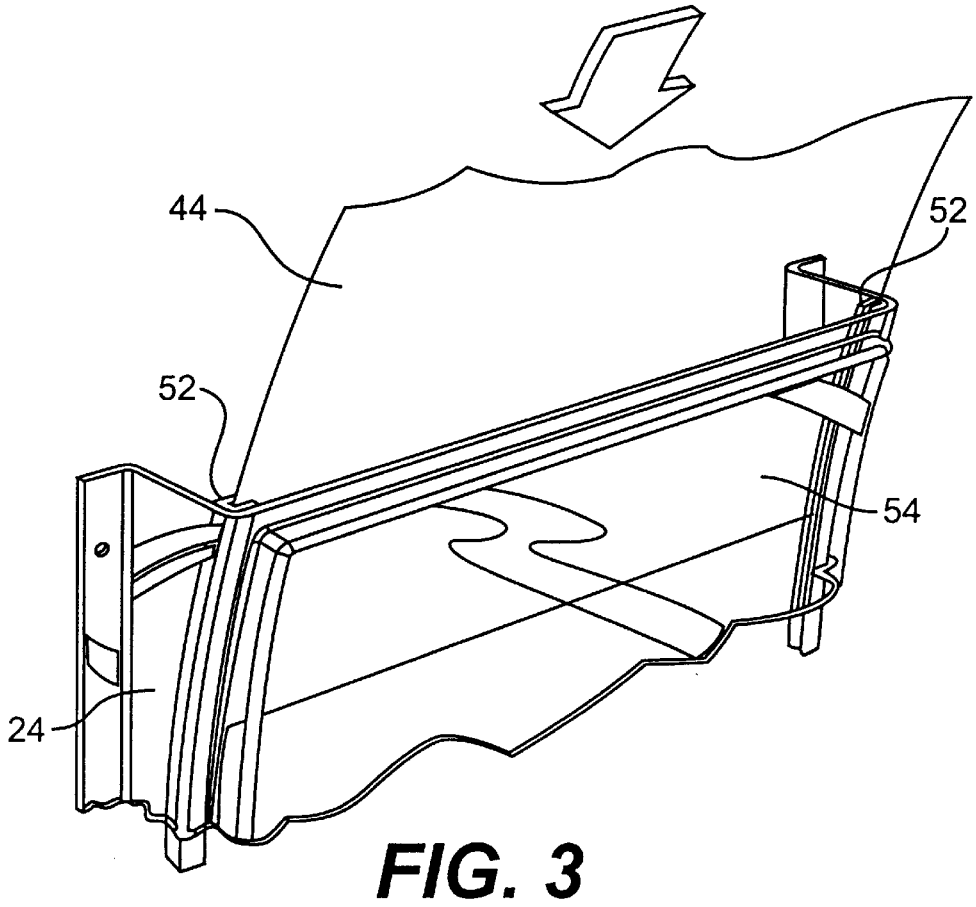
FIG. 3 is a partial perspective view of the vending machine of the present invention showing the graphics piece being inserted into its track.

When the access panel 46 is moved to the open position shown in dashed lines in FIG. 2, the graphics piece 44 may be removed by vertically sliding the graphics piece 44 out of a pair of channels 52, shown in FIG. 3, which receive side edges of the graphics piece 44. As shown in FIG. 3, the graphics piece 44 is located behind a transparent window 54 which protects the graphics piece 44 from damage. The transparent window 54 is generally thicker than the graphics piece 44 in order to protect the window 54 and the graphics piece 44 from damage from impacts and the like. Of course this transparent window 54 could be omitted and the graphics piece 44 would be directly exposed to the ambient environment.

The graphics piece 44 may be formed of a very thin plastic material which can even be rolled up for storage purposes before placing the graphics piece 44 in the vending machine face 24. An example of the graphics piece 44 is shown in U.S. Pat. No. 5,509,225, the entire contents of which are hereby incorporated by reference.

As shown in the first embodiment of FIG. 2, the access panel 46 is openable even if the main vending machine door 26 is in a closed position. It is simply necessary to open a piece of the trim (access panel 46). Therefore, it is possible for a service person to change the graphics piece 44 without obtaining access to the money box 28 located within the interior of the vending machine 10 which is only accessible by unlocking the main vending machine door 26.

Figure 4:
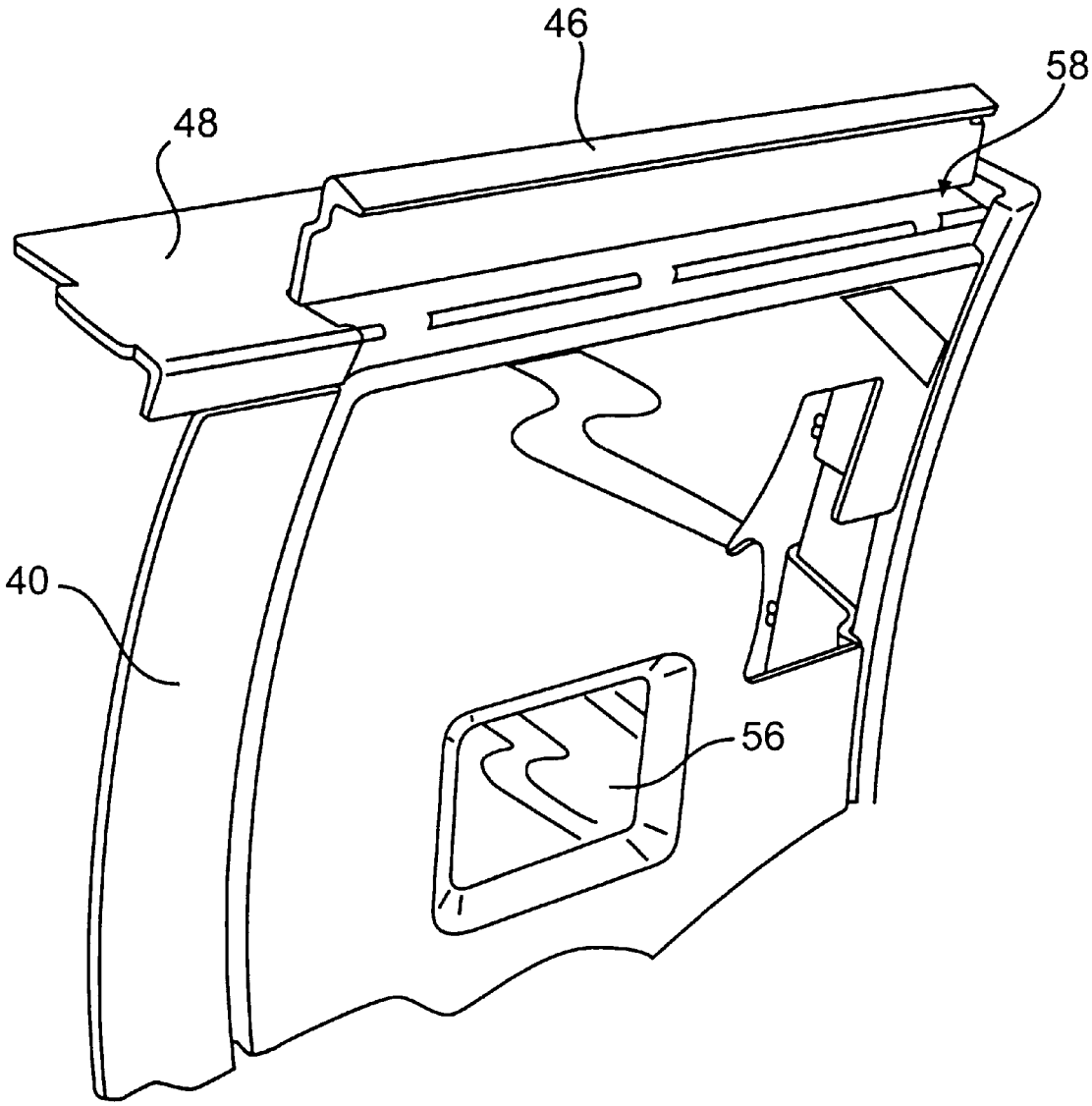
FIG. 4 is a partial perspective view of an alternative graphics piece which includes a video screen.

Turning now to FIG. 4, an alternative example of the graphics piece 44 is shown. In FIG. 4, the graphics piece 44 comprises an interactive touch screen or video display unit 56 which can display, for example, a map. In this embodiment, the top of the graphics piece 44 is designed to be larger than the opening 58 provided by the access panel 46 such that access to the video display unit 56 is not possible even if the access panel 46 is opened. Only by opening the main vending machine door 26 is access to the video display unit 56 possible. Thus, the access panel 46 provides a mechanism whereby relatively inexpensive graphics pieces, such as graphics piece 44, may be changed by merely opening the access panel 46, and where relatively expensive pieces, such as the video display unit 56, may be designed such that they cannot be removed through the access panel 46.

An important aspect in the security of a graphics piece 44 is making the access panel 46 as inconspicuous as possible. For example, in the first embodiment shown in FIG. 1, the locking fasteners 50 are located on the top of the trim piece 48 which is out of sight of the casual vandal which may attempt to open the access panel 46 for removal of the graphics piece 44.

Figure 5:
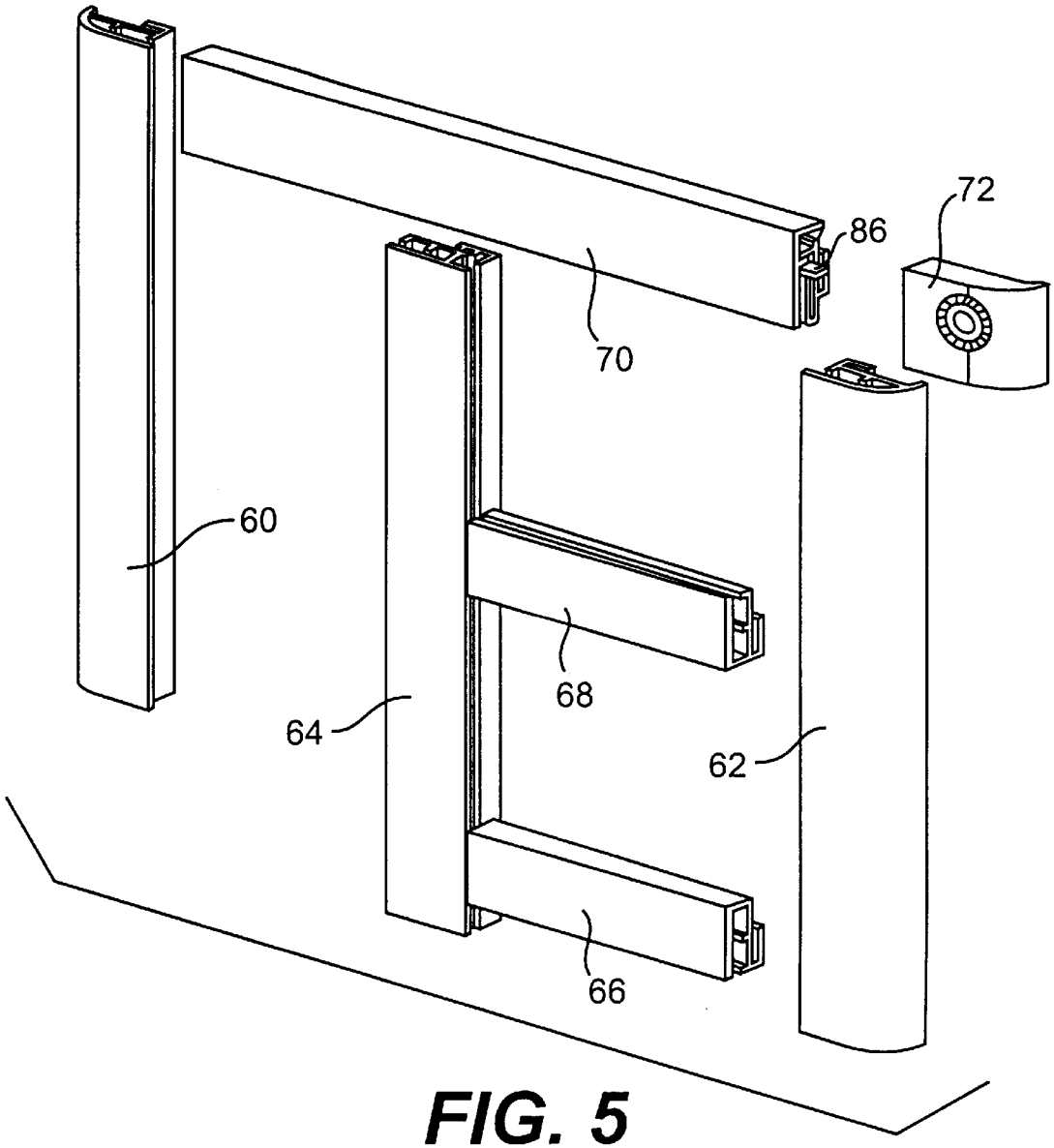
FIG. 5 is a front exploded perspective view of the face trim for the vending machine of the present invention.
Figure 6:
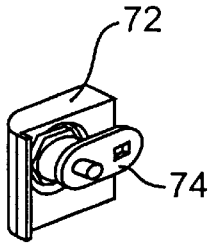
FIG. 6 is a perspective view of a locking mechanism for one of the trim pieces for the vending machine of the present invention.

To further disguise the access panel 46, a second embodiment is shown in FIG. 5, wherein the access panel 46 comprises most or all of the entire top trim piece of the vending machine as opposed to comprising a door-like portion as part of the upper exterior trim piece 48. In the embodiment shown in FIG. 5, a plurality of trim pieces are shown. The number and arrangement of the trim pieces may vary according to the desired look and arrangement of the face 24 of the vending machine 10. In FIG. 5, there is shown a left vertical trim piece 60, a right vertical trim piece 62, and a center column 64. Further, a lower horizontal trim piece 66, a middle horizontal trim piece 68, and an upper horizontal trim piece 70 are shown. In this embodiment, the upper horizontal trim piece 70 comprises the access panel 46. A locking mechanism 72 is arranged at the junction between the right vertical trim piece 62 and the upper horizontal trim piece 70. A rear view of the locking mechanism 72 is shown in FIG. 6. The locking mechanism 72 includes a rotatable locking element 74 for fastening the locking mechanism 72 to the face 24 of the vending machine 10.

Figure 7:
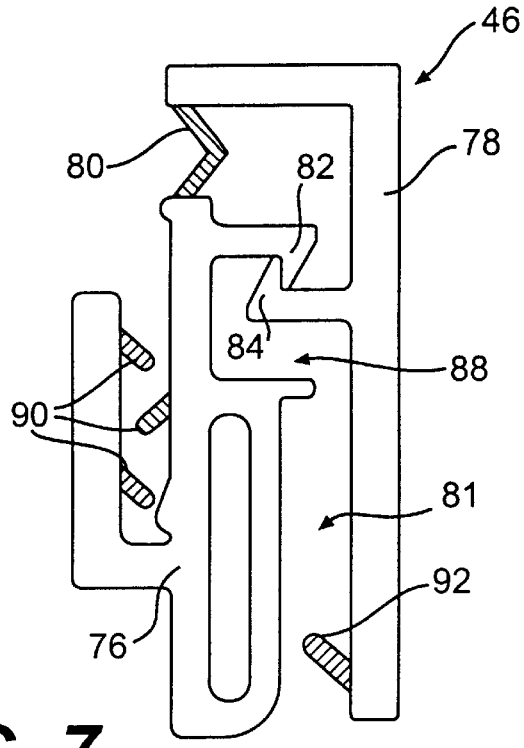
FIG. 7 is an enlarged side view of an upper trim access panel in a closed position.
Figure 8:
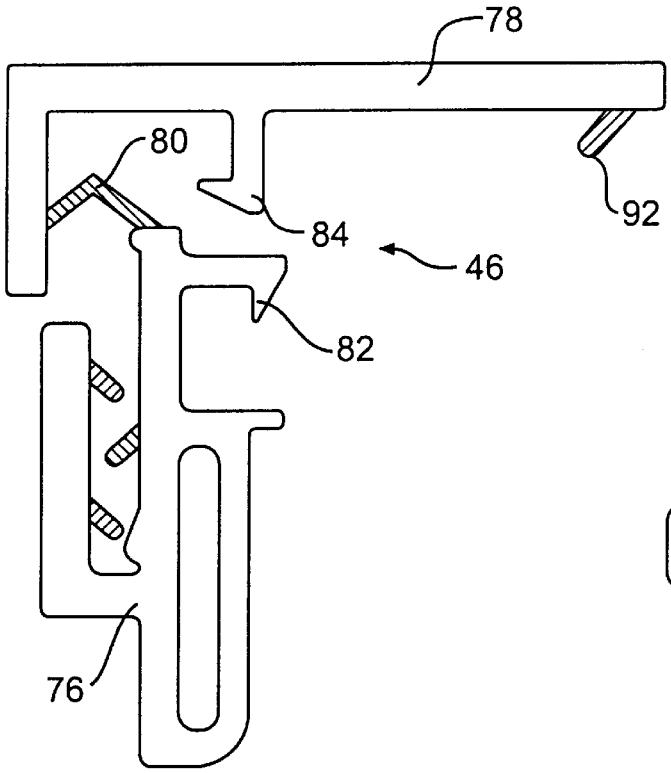
FIG. 8 is an enlarged side view of the upper trim access panel in an open position.

Enlarged side views of the upper horizontal trim piece 70 forming the access panel 46 are shown in FIGS. 7 and 8. FIG. 7 shows the access panel 46 in a closed position, and FIG. 8 shows the access panel 46 in an open position whereby the graphics piece 44 may be removed. As shown in FIG. 7, the upper horizontal trim piece 70 comprises a first portion 76 which is attachable to a frame 77 of the vending machine 10, and a second portion 78 visible from the exterior of the vending machine 10 which is pivotally attached to the first portion 76 by a compressible hinge 80. The compressible hinge 80 permits pivotable motion of the first portion 76 with respect to the second portion 78, and further provides limited linear movement of the second portion 78 with respect to the first portion 76 in a downward direction as viewed in FIG. 7. The graphics piece 44 is receivable in a space 81 located between the first portion 76 and the second portion 78.

The first and second portions 76, 78 include first and second locking hooks 82, 84, respectively, which are matingly engageable together as shown in FIG. 7. When the locking hooks 82, 84 are matingly engaged together, the second portion 78 is prevented from being pulled away from the first portion 76, for example, by a vandal attempting to forcibly open the access panel 46.

Figure 9:
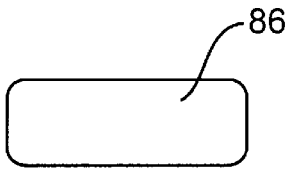
FIG. 9 is an enlarged side view of a locking bar for locking the upper trim access panel.

In order to prevent the second portion 78 of the access panel 46 from being compressed downwardly, a locking bar 86 shown in FIG. 9 is inserted into a gap 88 located between the second locking hook 84 and the first portion 76. The locking bar 86 is shown in an installed position in FIG. 5. The locking bar 86 extends across the entire width of the access panel 46 to prevent any portion of the access panel 46 from being compressed downwardly to disengage the matingly engaged locking hooks 82, 84. Of course, this bar 86 would be shortened such that it extends only across a majority of the width of the access panel. In fact, the length of the bar needed merely needs to be sufficient to prevent compression of the access panel 46 and therefore, this bar could extend over less than a majority of the access panel's width.

Upon removal of the locking mechanism 72 as shown in FIG. 5, a service person may slide the locking bar 86 out of the gap 88 by pulling the locking bar 86 rightwardly as viewed in FIG. 5. Thereafter, the service person may compress the second portion 78 of the upper trim piece 70 downwardly to disengage the locking hooks 82, 84, and thereafter may pivot the second portion 78 outwardly and upwardly into a position as shown in FIG. 8. Thereafter, the graphics piece 44 may be removed in the manner described above with respect to FIGS. 2 and 3.

It is conceivable that an alternative locking bar may be provided which is located between the top of the first locking hook 82 and the second portion 78, ie., located adjacent to the compressible hinge 80, which would prevent the second portion 78 from being moved downwardly as viewed in FIG. 7 to disengage the locking hooks 82, 84.

As shown in FIGS. 7 and 8, the first portion 76 includes a plurality of fastening elements 90 for fastening the first portion 76 to the frame 77 of the face 24. Further, the second portion 78 includes a projecting member 92 to assist in retaining the graphics piece 44 in place when the access panel 46 is in a closed position as shown in FIG. 7.

Figure 10:
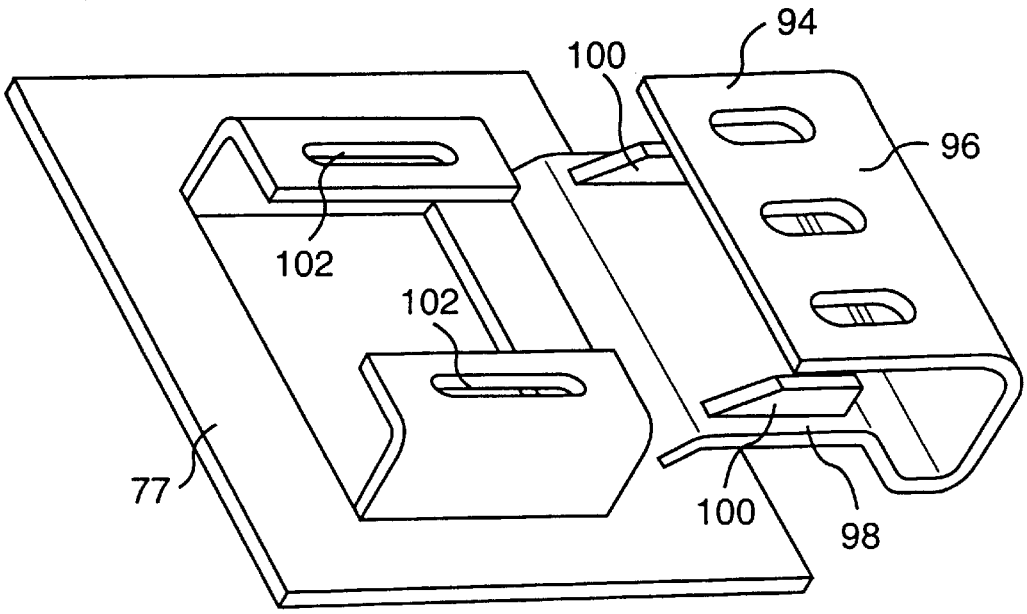
FIG. 10 is a perspective view showing a clip for attaching the trim pieces to the frame of the vending machine of the present invention, with the clip being inserted into a slot in the frame.
Figure 11:
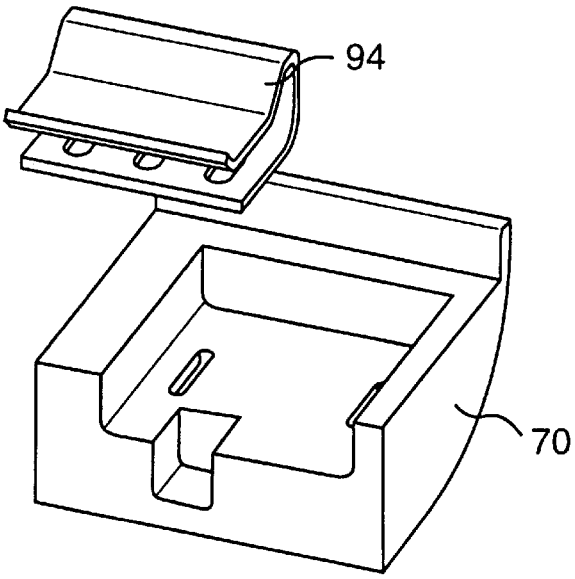
FIG. 11 is a perspective view showing the clip of FIG. 10, with the clip being inserted into a trim piece.
Figure 12:
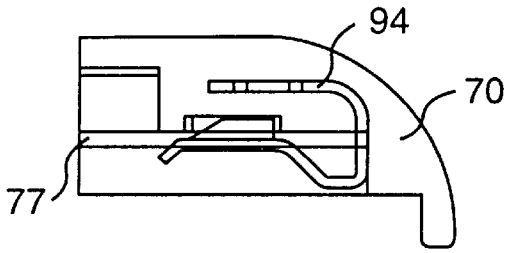
FIG. 12 is a side view showing the clip of FIGS. 10 and 11 in an installed position joining together the trim piece to the frame.

Referring now to FIGS. 10–12, a clip 94 for fastening the trim pieces 60–70 to the frame 77 of the face 24 is shown. While the following discussion specifically refers to the upper trim piece 70, it is to be understood that the same discussion would apply to the remaining trim pieces 60–68, or any trim piece located on the face 24 of the vending machine 10.

The clip 94 comprises a first portion 96 attachable to the upper trim piece 70, and a second portion 98 attachable to the frame 77. The second portion 98 includes a pair of projections 100 which are receivable in corresponding apertures 102 in the frame 77 for securing the clip member 94 to the frame 77. The clip member 94 is attached to the upper trim piece 70 as shown in FIG. 11. The clip member 94 is thereafter insertable into the frame 77 as shown in FIG. 10 until the pair of projections 100 are received in the apertures 102. At that time, the upper trim piece 70 is attached to the frame 77 as shown in FIG. 12. Thus, no special tools are required to attach the trim pieces 60–70 to the frame 77.

Figure 13:
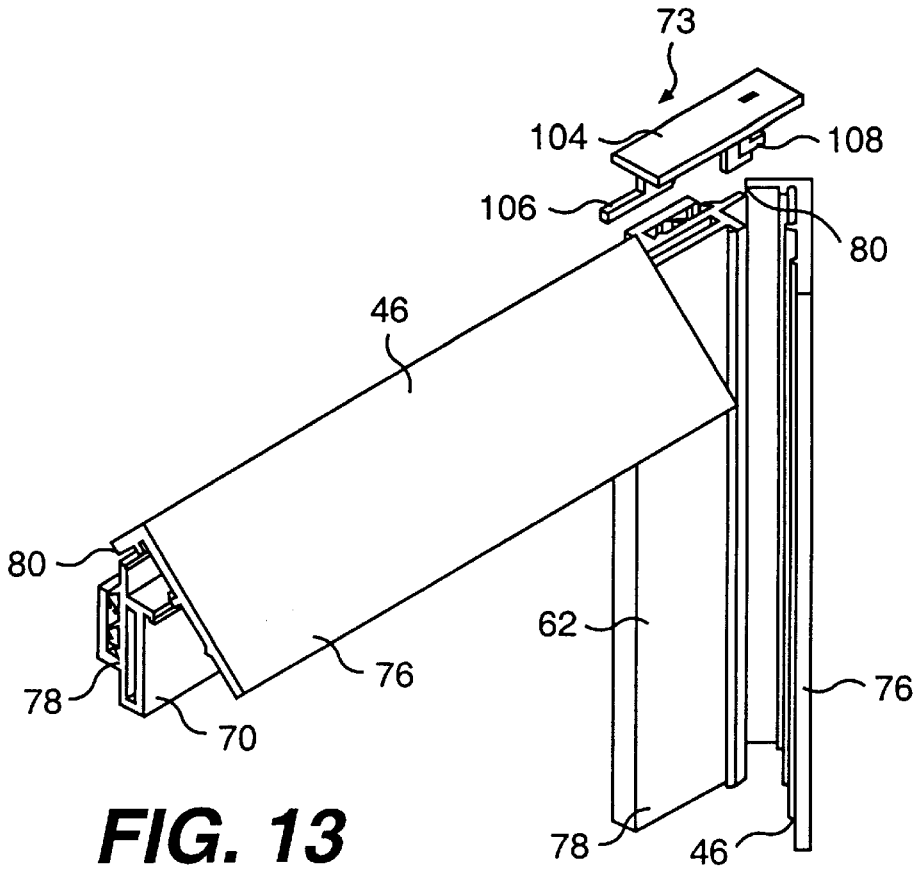
FIG. 13 is a perspective view, partially exploded, of an alternative embodiment showing access panels in the upper trim piece and the side trim piece, both in an open position.
Figure 14:
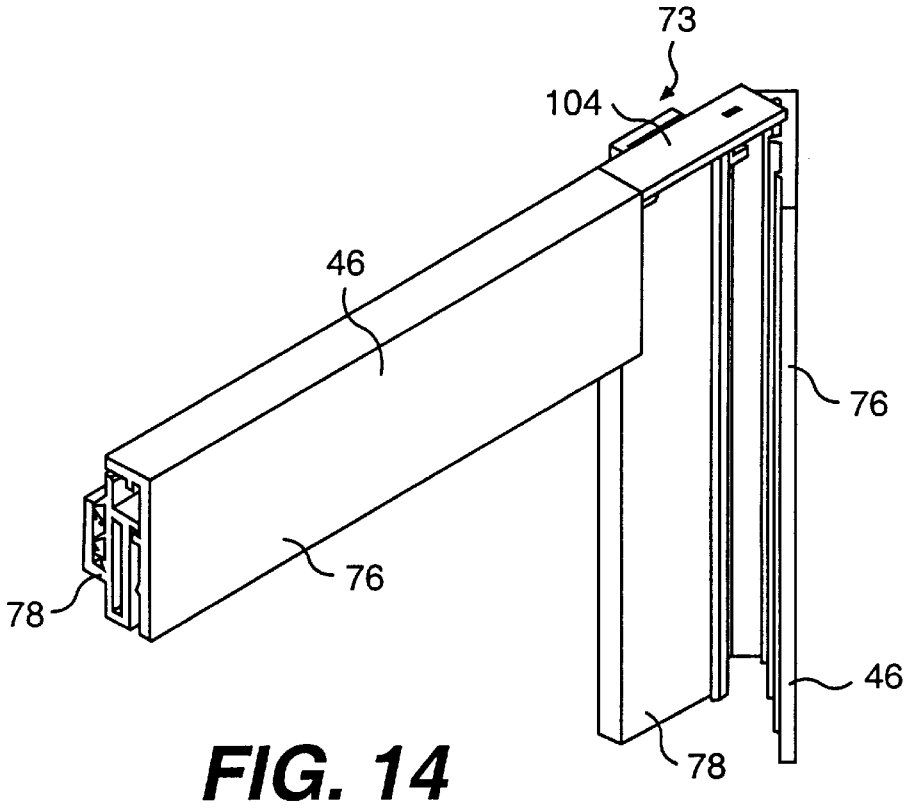
FIG. 14 is a perspective view of the embodiment of FIG. 13 showing the access panel of the upper trim piece in a closed position.

Referring now to FIGS. 13 and 14, an alternative configuration of the access panel 46 is shown. As shown in FIGS. 13 and 14, an access panel 46 may be provided in both the upper trim piece 70 and the right trim piece 62. The construction of the trim pieces 62,70 is similar to the embodiment shown in FIGS. 7 and 8.

An alternative form of locking mechanism 73 is shown in FIG. 13. The locking mechanism 73 of FIG. 13 includes a unitary locking member 104 having the locking bar 106 integral therewith. Although the locking bar 106 shown in FIG. 13 is shown as being relatively short, the locking bar 106 preferably extends filly across the width of the access panel 46. Alternatively, a pair of locking mechanisms 73 may be provided on each side of the access panel 46 at the corners thereof in order to prevent the access panel 46 from being compressed and thereafter pivoted so that the graphics piece 44 could be removed.

In the embodiment of FIG. 13, because an additional access panel 46 is provided on the right vertical trim piece 62, additional locking bars 108 are provided on the locking mechanism 73 to prevent the vertical access panel 46 from being compressed leftwardly to disengage the locking hooks 82, 84.

Figure 15:
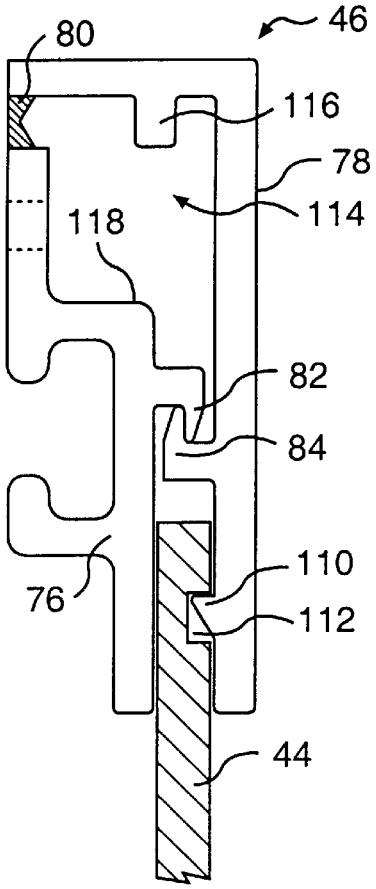
FIG. 15 is an enlarged side view of an alternative embodiment of the upper trim piece in a closed position.

An enlarged side view of a similar access panel 46 is shown in FIG. 15. In the embodiment of FIG. 15, a bar-like projection 110 is provided on the second portion 78 of the access panel 46 which engages a corresponding recess 112 in the graphics piece 44 to hold the graphics piece 44 in place. The first portion 76 is shaped slightly differently for attachment to an alternatively configured frame 77 of the vending machine face 24. The embodiment of FIG. 15 also includes the compressible hinge 80 and operates in the same manner as the previous embodiments.

Although not shown in FIG. 15, a locking bar would be provided in the space 114 between a depending lug 116 of the second portion 78 and a shoulder 118 of the first portion 76 in order to prevent the locking hooks 82, 84 from becoming disengaged from one another, and to thereby prevent the compressible hinge 80 from being compressed.

Figure 16:
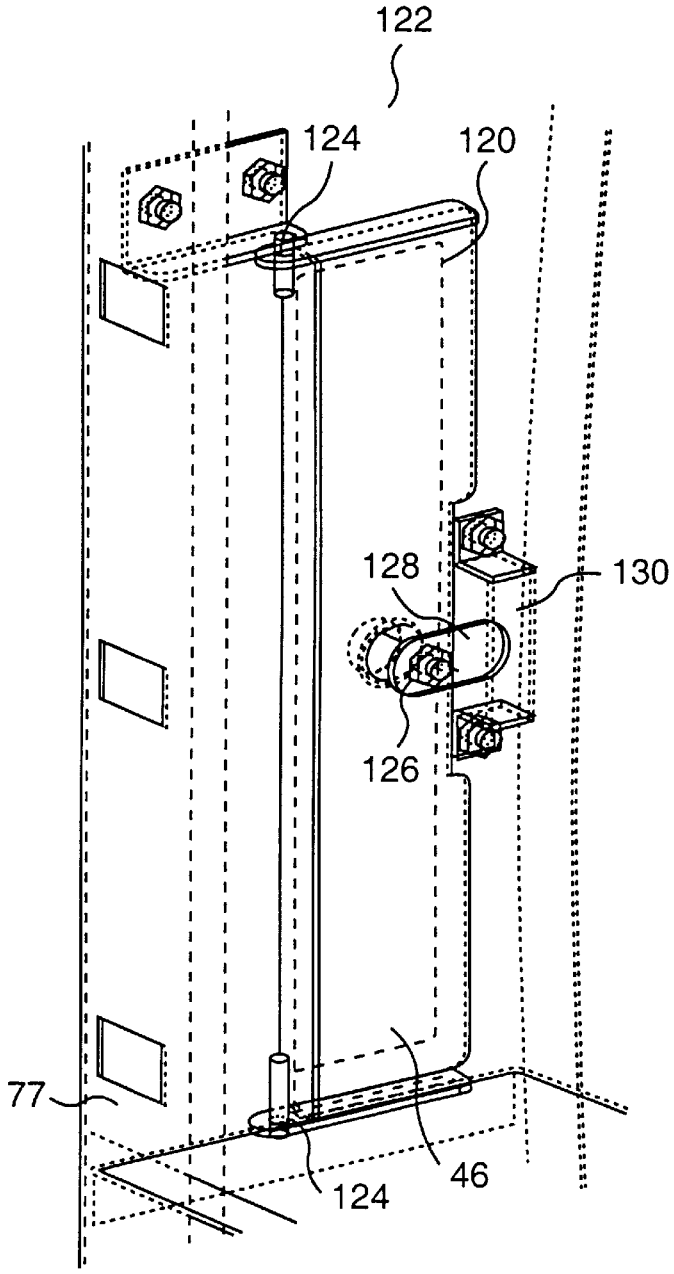
FIG. 16 is a perspective view of another alternative embodiment of the access panel showing the access panel in a side of the vending machine face.

Yet another embodiment of the access panel is shown in FIG. 16. The access panel 46 is provided in the frame 77 of the face 24. The frame 77 includes an elongated aperture 120 in a wall 122 thereof. The access panel 46 is pivotally mounted to the frame 77 by a pair of spaced-apart pivots 124. The access panel 46 is movable from a closed position as shown in FIG. 16 where the access panel 46 blocks the elongated aperture 120, to an open position where the access panel 46 does not block the elongated aperture 120, and a service person may access a graphics piece 44 through the elongated aperture 120. A locking mechanism 126 is provided which includes a rotatable lug 128 which, when rotated to the position shown in FIG. 16, prevents the access panel 46 from opening due to the engagement of the lug 128 with a locking plate carrier 130. A key and lock arrangement can be used, for example, to lock the access panel 46 in a closed position.

Figure 17:
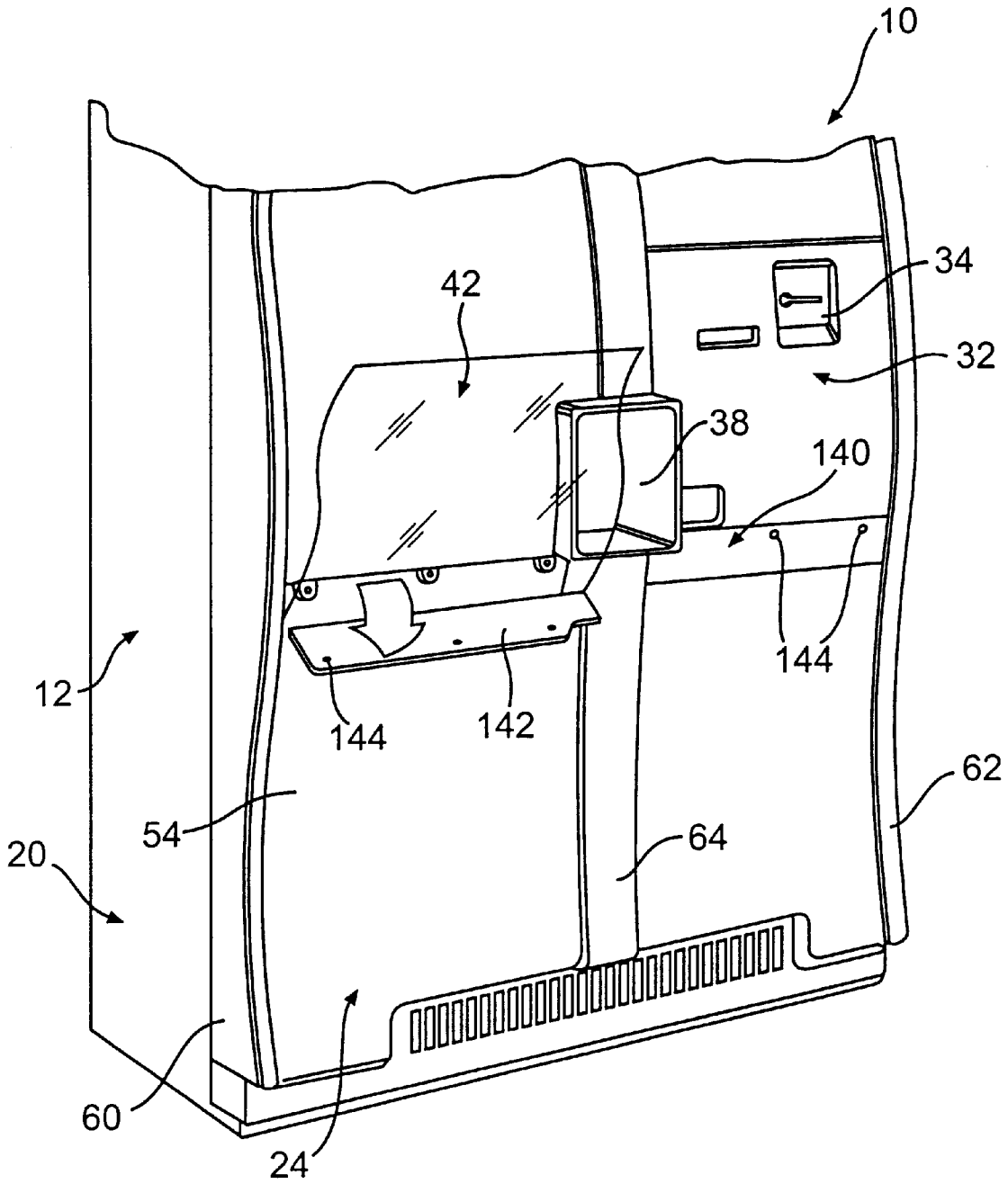
FIG. 17 is a partial perspective view a vending machine of the present invention showing an access panel in the front face thereof.
Figure 18:
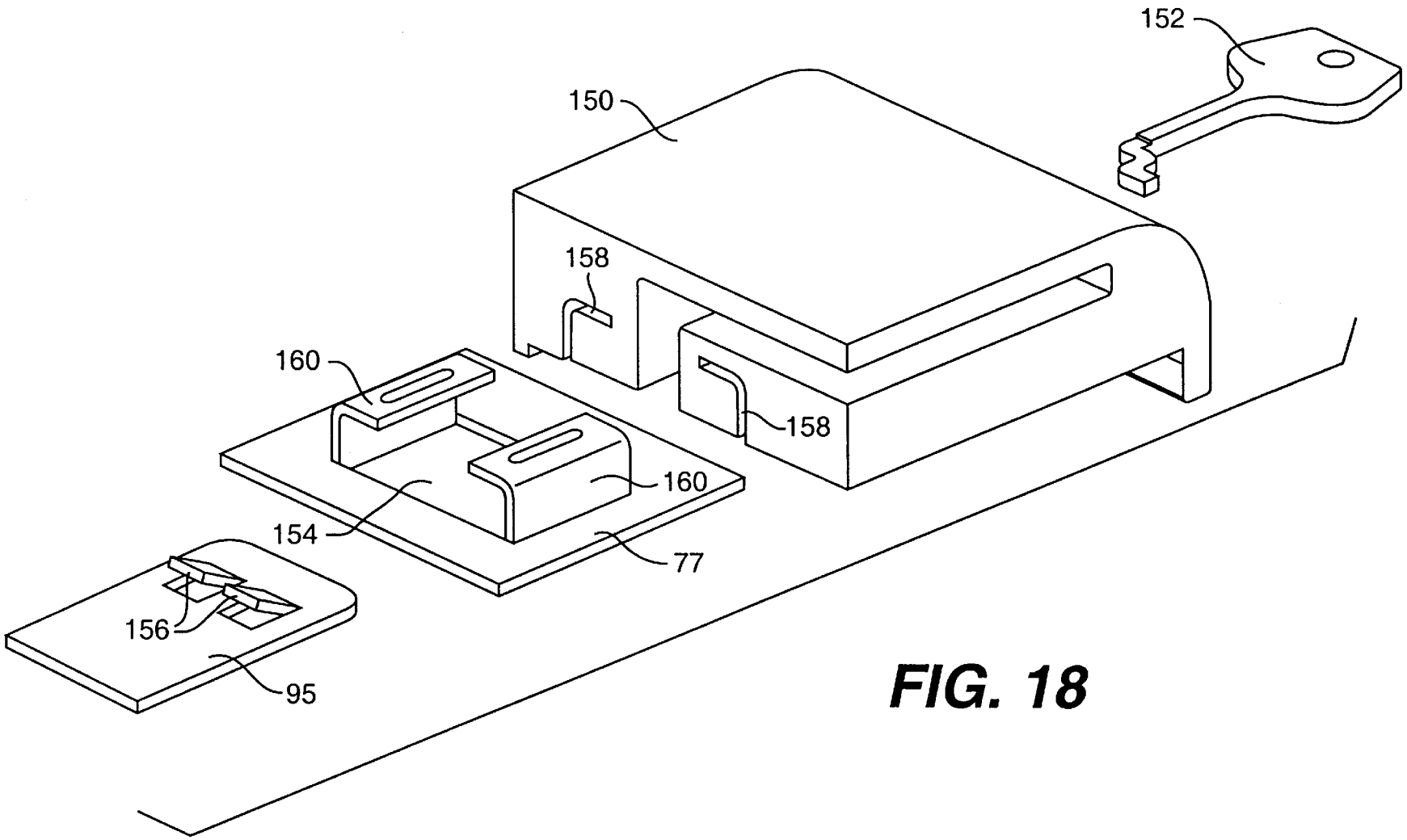
FIG. 18 is a front exploded perspective view of a third embodiment showing a clip for attaching the trim piece to the vending machine of the present invention and showing an opening tool.

FIG. 17 shows a further embodiment of the access panel 46 wherein the access panel 46 is provided in a horizontal middle trim piece 140 of the vending machine face 24. In the embodiment of FIG. 17, the access panel 46 is formed as a flip-down panel 142. When the flip-down panel 142 is open, the graphics piece 44 can be slid or otherwise removed from the face 24. A plurality of key locks or special fasteners 144 are provided to lock the access panel 46 in the closed position. While three separate locks 144 are shown in FIG. 17, any number or placement of locks 144 can be utilized.

Figure 19:
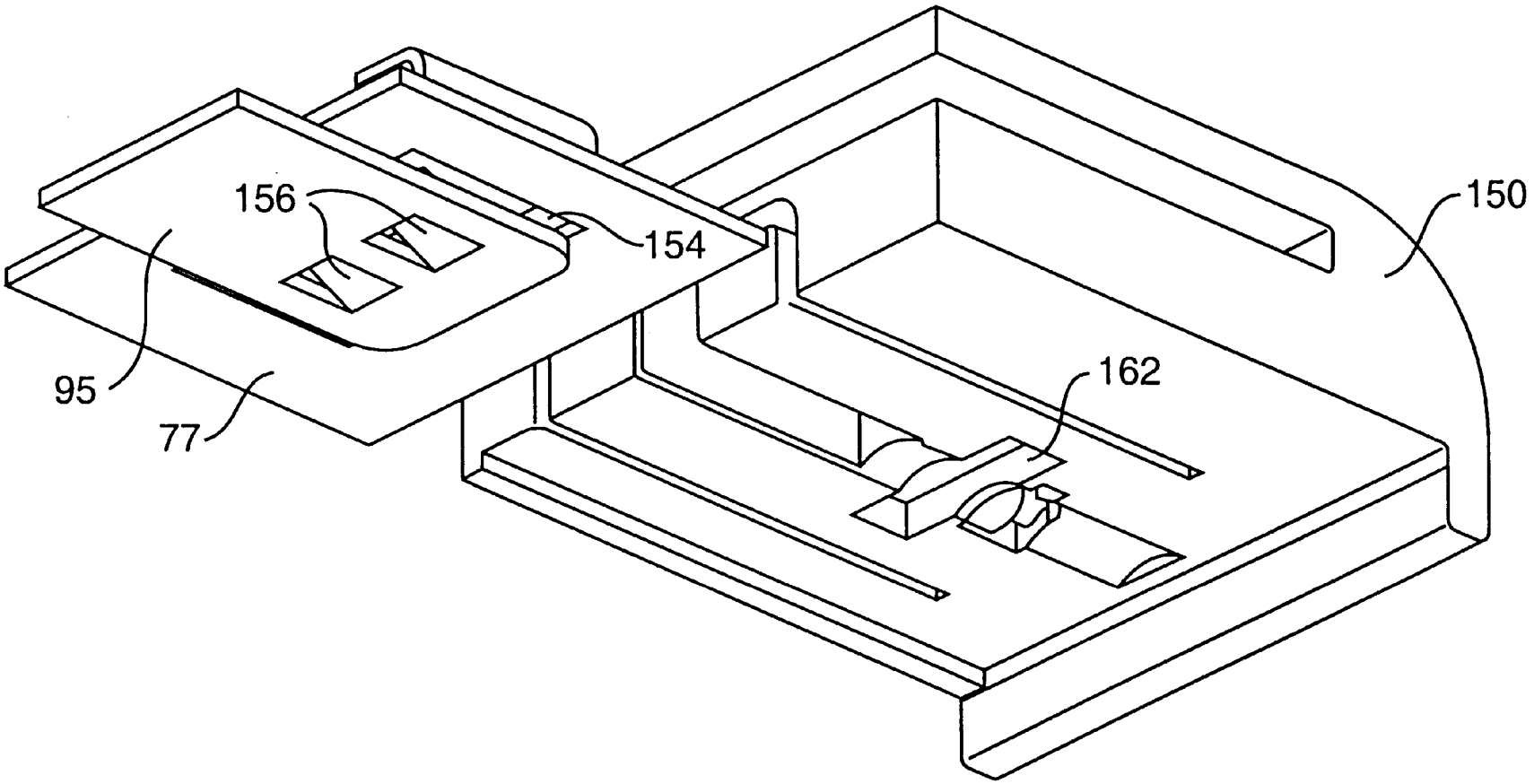
FIG. 19 is a bottom perspective view of the embodiment of FIG. 18 showing the clip on the flange.
Figure 20:
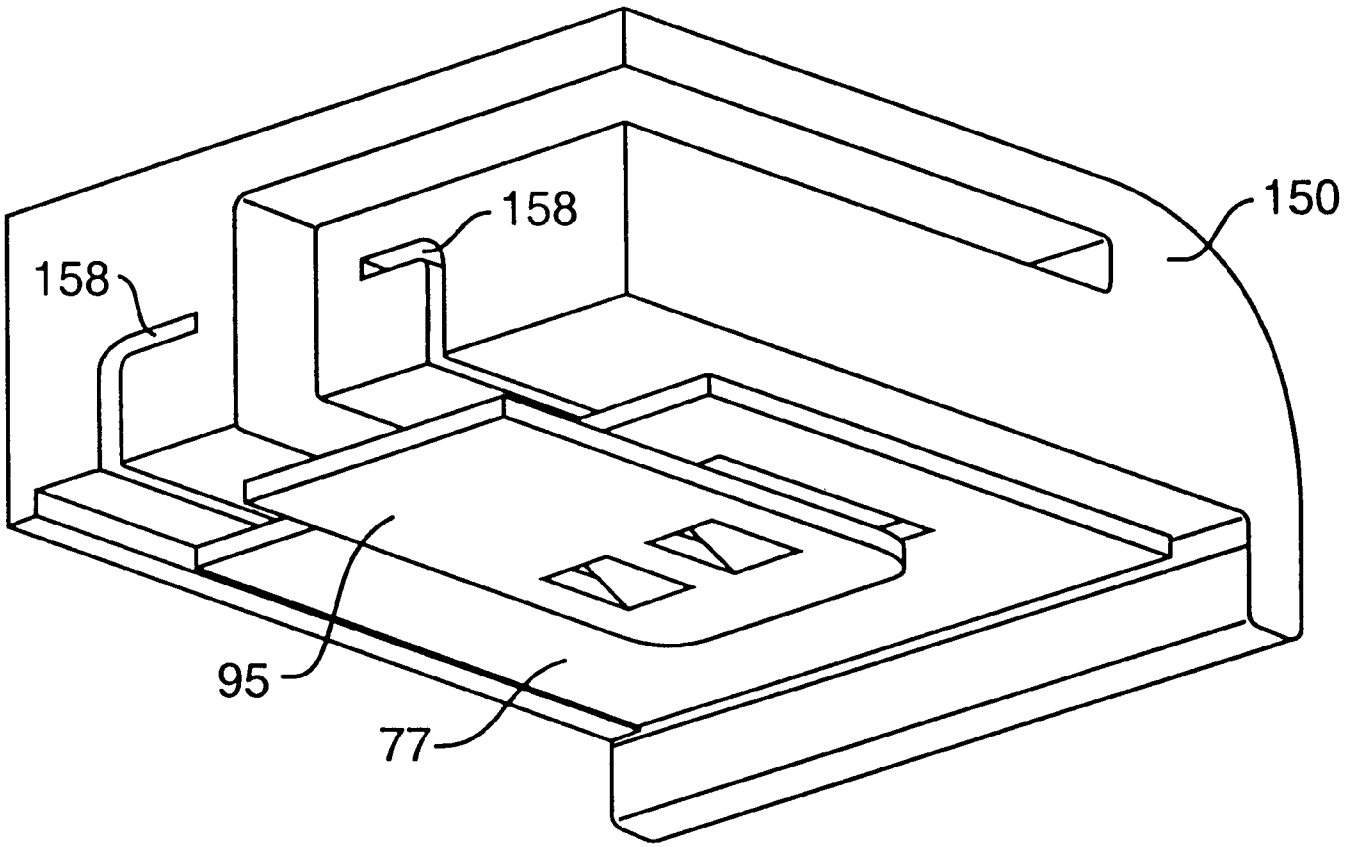
FIG. 20 is a bottom perspective view similar to FIG. 19 showing the trim piece in an installed position.
Figure 21:
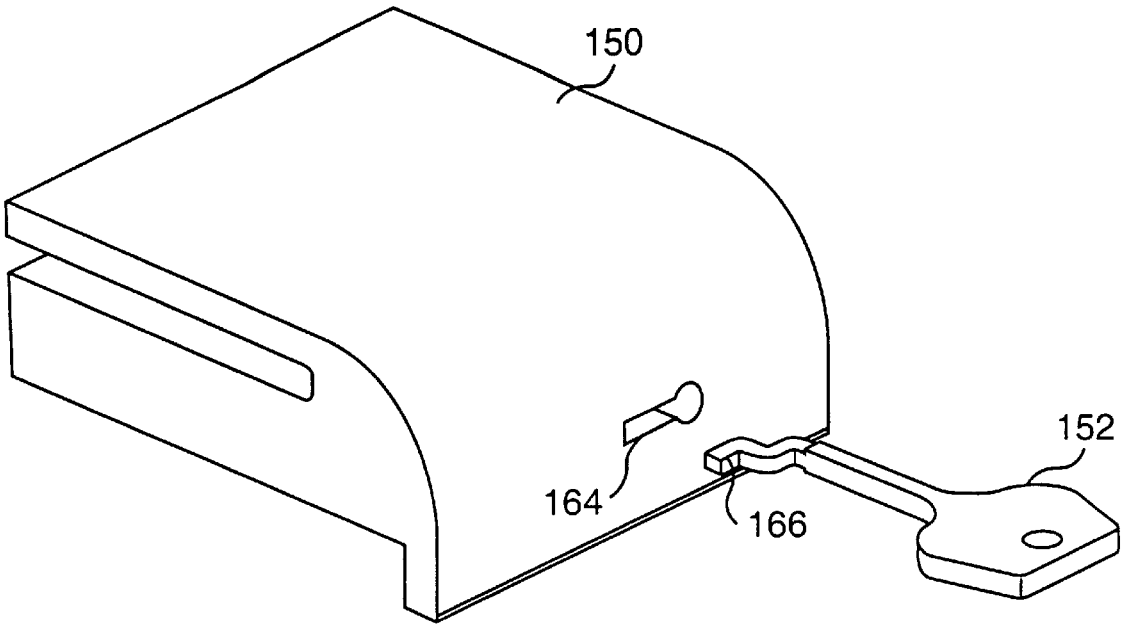
FIG. 21 is a end view of the opening tool and trim piece of the third embodiment.

Turning now to FIGS. 18–25, a third embodiment of the access panel is shown. In this embodiment, the locking mechanism 72 in FIG. 5 is replaced by an end cap 150. Similarly to the embodiment of FIG. 5 and as shown in FIG. 10, this third embodiment has a frame 77. The frame 77 is attached to the vending machine. A pivotable clip 95 is provided and as shown in FIG. 19 is received in opening 154 of frame 77. The clip 95 can be pivotably attached to frame member 77 or some other member of the frame of the vending machine. It is contemplated that this clip 95 will pivot such that the projections 156 will move in and out of the opening 154 of frame 77 as will be described in more detail below.

The end cap 150 conforms to the shape of the left or right vertical trim pieces 60 or 62, for example. As noted above, the locking mechanism 72 can be replaced with this end cap 150. In order to move the trim pieces to an open position, this end cap 150 can be removed similarly to the locking mechanism 72 in order to permit removal of a locking bar 86. The end cap 150 has a curved rear end which conforms with the shape of the vertical trim pieces 60, 62, to therefore blend in with the face of the vending machine. This helps to keep the means for accessing the graphics hidden.

In order to mount the end cap 150 onto the vending machine face, it is longitudinally slid such that slots 158 will slide over projections 160. These projections 160 are part of the vending machine frame 77. As seen from FIGS. 18, 19 and 20, the interfitting of pieces 150, 77 and 95 is shown. While the clip 95 is shown as a separate piece from the frame member 77, these two pieces can be pivotably connected or this clip 95 can be connect to another portion of the vending machine frame. When the end cap 150 is slid onto the projections 160 of the frame 77, the tab 95 will have its projections 156 engaged in cavity 162 on the underside of the end cap 150. This effectively locks the end cap 150 on the vending machine frame 77. If someone were to attempt to pull the end cap 150 from the vending machine frame, the raised projections 156 would engage the walls of cavity 162 and prevent this removal. While not shown, the clip 95 can be biased upwardly to ensure engagement of the projections 156 in the cavity 162. For example, a spring or other biasing means could be used for urging the clip 95 in this direction.

Figure 22:
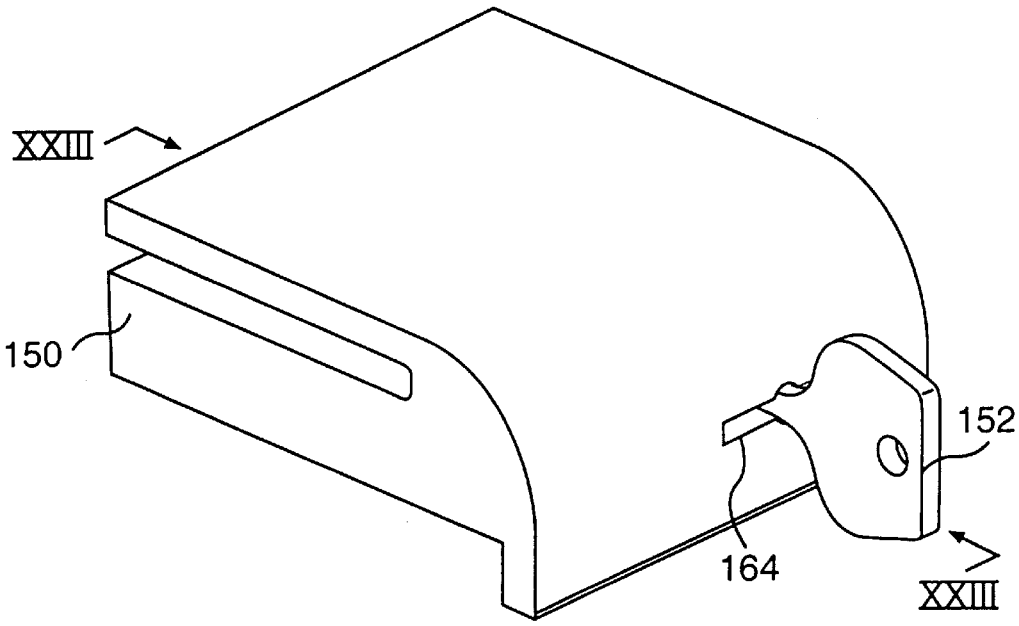
FIG. 22 is a view similar to FIG. 21 showing the opening tool inserted in the trim piece opening.
Figure 23:
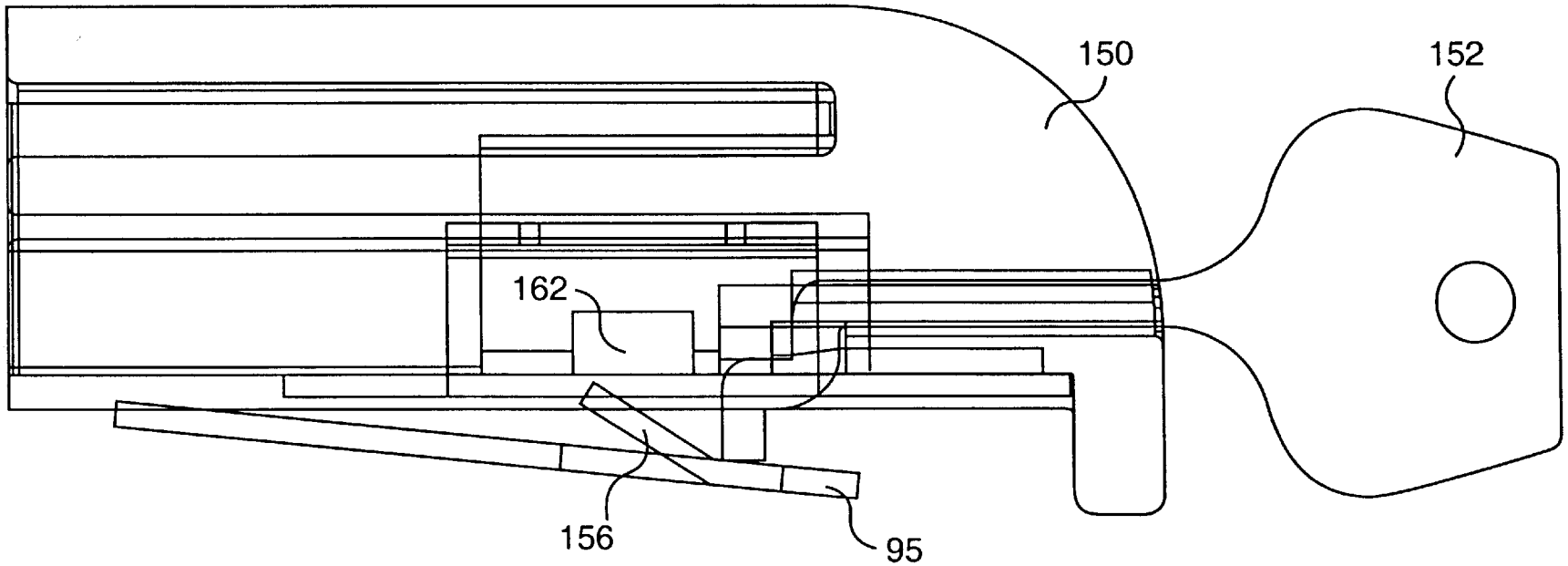
FIG. 23 is a cross-sectional view of FIG. 22 taken along line XXIII—XXIII.

When it is desired to remove a graphics piece from the face of the vending machine, an opening tool 152 can be inserted in slot 164 in the end of the cap 150. After insertion, the opening tool 152 can be rotated 90° as shown in FIG. 22. This will cause the end 166 of the opening tool 152 to engage the top of the spring biased clip 95 as shown in FIG. 23. This engagement will overcome the force of the spring or other biasing means and move the projections 156 of the clip 95 out of the cavity 162. The end piece 150 can then be slid from the frame 77. Thereafter, the vertical trim pieces can be moved to an open position in order to release the graphics piece.

Figure 24:
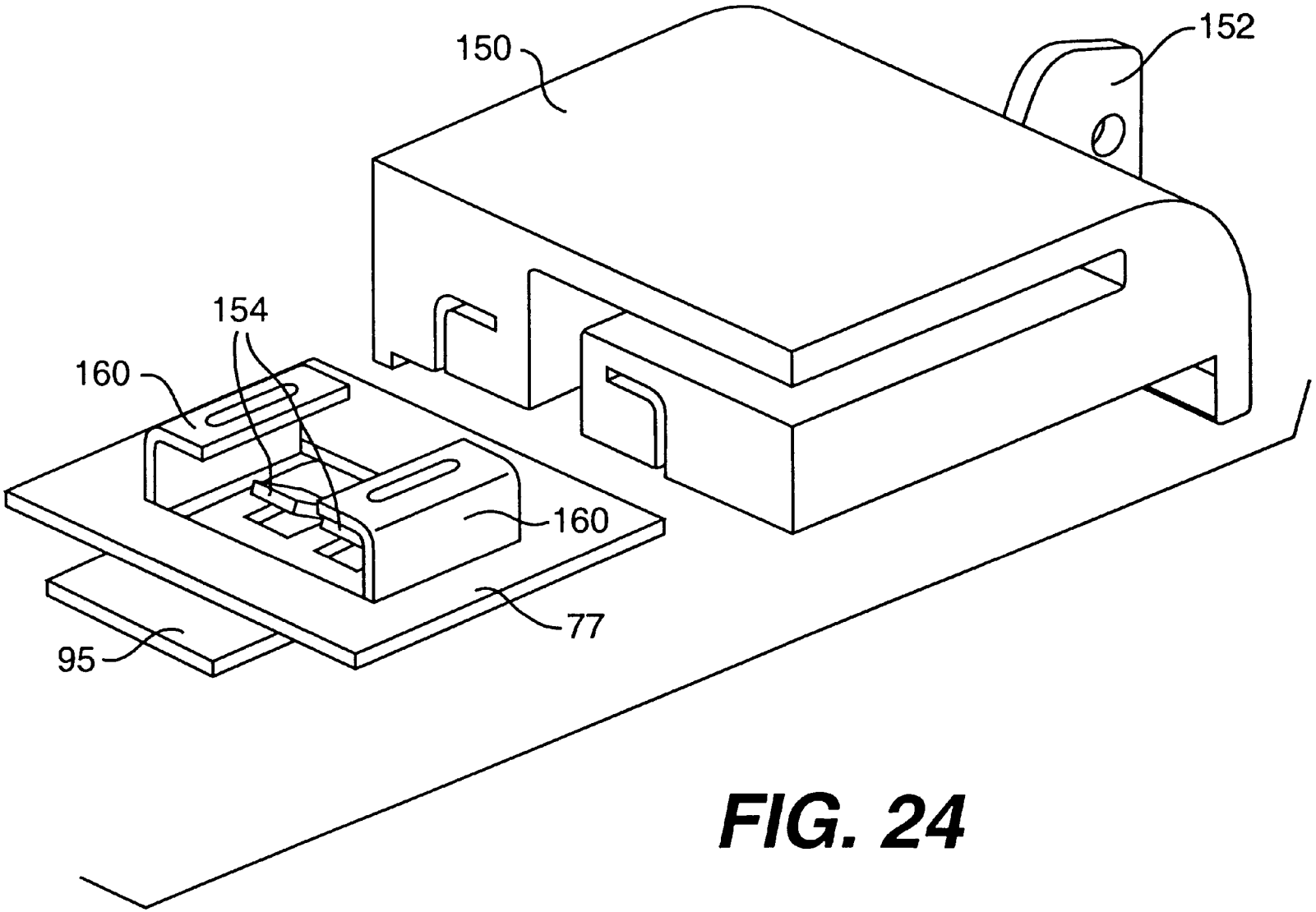
FIG. 24 is a front perspective view showing the trim piece removed from the clip.
Figure 25:
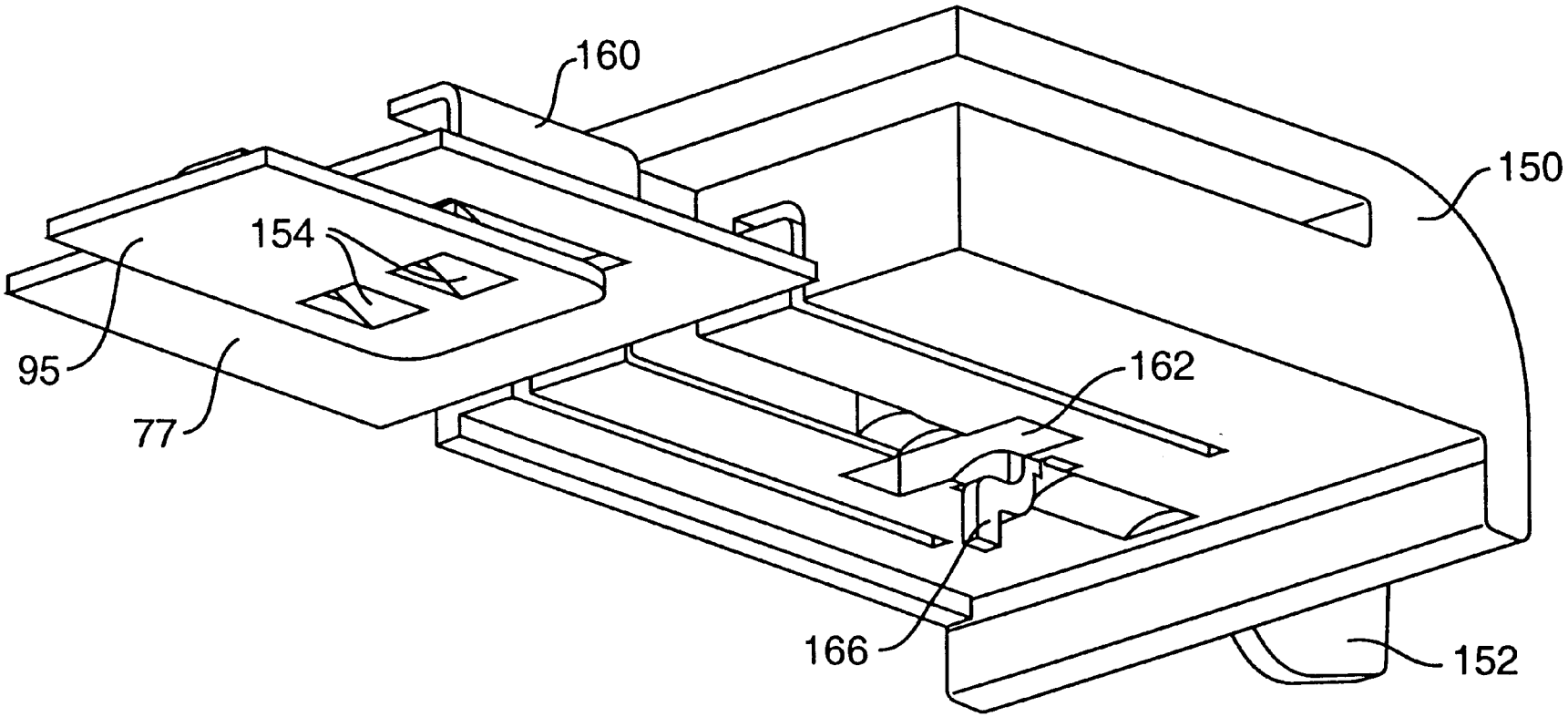
FIG. 25 is a bottom perspective view of FIG. 24.

FIGS. 24 and 25 show the removal of the end piece 150. The end 166 of the opening tool 152 is shown projecting from the cavity 162 in FIG. 25. While a key-type opening tool 152 has been used, it is contemplated that any suitable tool can be used. For example, a specially shaped screwdriver or an Allen wrench could be used in order to detach the clip 95 from engagement with the end cap 150. Upon removal of the end cap 150, the locking bar can be withdrawn from the trim piece which will thereafter be opened.

With the access panels 46 shown in the present invention, the graphics pieces 42, 44 can be slid or otherwise removed from the vending machine face 24 without the need for opening the main vending machine door 26. Therefore, a service person could open the access panel 46 to access the graphics piece 44 and change the graphics piece 44 without opening the vending machine door 26. This would allow the owner of the vending machine 10 to give someone the task of changing the graphics piece 44 without having to worry about the security of the money inside of the money box 28 or the security of the product in the vending machine 10. The person could have a key which would only give limited access to the panel 46 instead of a key to the lock 30 of the vending machine door 26. Without the key or special tool, however, the graphics piece 44 would be securely held in the face 24 to prevent theft or vandalism of the graphics piece 44.

The graphics pieces 42, 44 can be thermoformed panels of clear material having appropriate graphics thereon. A light box (not shown) can be included in the face 24 behind the graphics piece 44, or can be omitted. With this vending machine face 24, it is easy to switch from one promotion to another by simply and easily changing the graphics pieces 42, 44. The vending machine 10 will clearly communicate to the consumer what item is being dispensed or promoted at that particular time. Therefore, the appearance of the vending machine 10 can be completely changed very easily without risking the security of the money or products inside of the money box.

It should be understood that the key or special tool which opens the access panel 46 will not fit the lock 30 which opens the main vending machine door 26. However, it is contemplated that the key which fits the main vending machine door 26 may additionally fit the locks 50, 72, 104, 126, 144 of the access panels 46 such that a fully authorized person may access both the main vending machine door 26 and the access panel 46 with the same key. Thus, the key would act as a master key for the authorized service person, while non-master-type keys could be distributed to persons only authorized to change to graphics pieces 42, 44.

The exterior trim pieces 48, 60–70 are preferably formed of a thermoformed plastic. However, any suitable material, such as metal, may be utilized. Further, while a compressible hinge 80 is shown in each of the embodiments, it is conceived that a standard-type pivoting hinge may be utilized which additionally includes a slidable portion which permits the limited linear movement of the second portion 78 of the access panel 46 with respect to the first portion 76. With regard to the matingly engageable locking hooks 82, 84, these locking hooks 82, 84 extend across the entire width of the access panel 46. However, it is conceivable that a plurality of spaced-apart individual locking hooks 82, 84 may be utilized instead. Although the access panel 46 in the embodiments shown herein is relatively flat with square edges, any desired shape of the access panel 46 may be utilized, such as a curved shape similar to the exterior trim pieces 60, 62 which form the vertical sides of the vending machine face 24.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vending machine face having at least one graphics piece therein, said vending machine face comprising:

a movable door that provides access to an interior of a vending machine, the door having a first exterior surface, the first exterior surface having a transaction area including at least one product selection button, the door also having a second exterior surface, the second exterior surface being formed by an outwardly facing side of at least one side wall extending substantially perpendicular to a periphery of the first exterior surface; and an access panel provided in said door and forming at least a portion of at least one of the first exterior surface and the second exterior surface, said access panel being movable, relative to the door, from a closed position prohibiting access to such a graphics piece, to an open position permitting access to such a graphics piece for removal thereof.

2. The vending machine face as recited in claim 1, wherein said vending machine face includes at least one exterior trim piece, said access panel being located in said trim piece.

3. The vending machine face as recited in claim 2, wherein the locking mechanism includes a pivotable clip and an end cap, the end cap having generally a same configuration as the at least one trim piece, the end cap further having an interior cavity and the clip having at least one projection received in the interior cavity of the end cap when the access panel is locked, the at least one projection being movable out of the interior cavity upon pivoting of the clip to thereby release the end cap for opening of the access panel.

4. The vending machine face as recited in claim 1, wherein said access panel comprises an exterior trim piece of said vending machine face.

5. The vending machine face as recited in claim 1, wherein said vending machine face further includes a frame and at least one exterior trim piece, and a clip member for attaching said trim piece to said frame.

6. The vending machine face as recited in claim 5, wherein said clip member comprises a first portion attachable to said trim piece, and a second potion attachable to said frame, said second portion having a pair of projections receivable in corresponding apertures in said frame for securing said clip member to said frame.

7. The vending machine face as recited in claim 6, further comprising at least one fastening element provided on the at least one trim piece, the at least one fastening element connecting the at least one trim piece to the clip member.

8. The vending machine face as recited in claim 7, wherein the at least one fastening element comprises a plurality of fastening elements, the clip member having a plurality of apertures with each of the apertures of the clip member receiving one of the fastening elements of the at least one trim piece whereby the trim piece is clipped onto the clip member to thereby attach the at least one trim piece to the clip member.

9. The vending machine face as recited in claim 5, wherein the exterior trim piece is a top trim piece located at a top of said vending machine face.

10. The vending machine face of claim 1, further comprising a locking mechanism for locking the access panel in the closed position.

11. A vending machine face having at least one graphics piece therein, said vending machine face comprising:

an access panel provided in said vending machine face, said access panel being movable from a closed position prohibiting access to such a graphics piece, to an open position permitting access to such a graphics piece for removal thereof, and a frame, wherein said access panel further includes:

a first portion and a second portion, said first portion being attachable to said frame; and a compressible hinge interconnecting said first portion to said second portion, said compressible hinge permitting pivotal movement and limited linear movement of said second portion with respect to said first portion.

12. The vending machine face as recited in claim 11, wherein said graphics piece is receivable in a space between said first portion and said second portion.

13. The vending machine face as recited in claim 11, wherein said first and second portions include first and second matingly engageable locking hooks, respectively, which, when matingly engaged together, prevent said second portion from being pulled away from said first portion.

14. The vending machine face as recited in claim 13, wherein said compressible hinge permits said limited linear movement of said second portion with respect to said first portion to allow said first locking hook to disengage said second locking hook, thereby permitting said second portion to pivotally move with respect to said first portion.

15. The vending machine face as recited in claim 14, further comprising a locking mechanism including a locking bar insertable into a gap between said first portion and said second portion for prohibiting said linear movement of said second portion with respect to said first portion, to thereby prohibit said first locking hook from disengaging said second locking hook.

16. A method of changing a graphics piece in a face of a vending machine, the vending machine having a main door movable between an open position permitting access to an interior of the vending machine, and a closed position prohibiting access to the interior of the vending machine, said door including a lock for locking said door in said closed position, said face including a graphics piece receiving area and an access panel, the access panel being movable from a closed position prohibiting access to the graphics piece, to an open position permitting access to the graphics piece for removal thereof, and a locking mechanism for locking said access panel in said closed position, said method comprising the steps of:

maintaining the vending machine door in a closed and locked position while performing the steps of:

unlocking said locking mechanism of the access panel;

opening the access panel;

selectively removing or inserting a graphics piece out of or into the graphics piece receiving area;

closing the access panel; and locking the locking mechanism of the access panel.

17. A vending machine face in combination with a vending machine cabinet, the vending machine face having at least one graphics piece therein, the vending machine face comprising:

a door that provides access to an interior of the vending machine cabinet, the door being movable from a first position prohibiting access to the interior of the vending machine cabinet to a second position permitting access to the interior of the vending machine cabinet, and an access panel provided in the vending machine face, the access panel being movable, relative to the door, from a closed position prohibiting access to the graphics piece, to an open position permitting access to the graphics piece for removal thereof;

wherein the access panel is movable from the closed position to the open position while the door is in the first position.

18. The vending machine face as recited in claim 17, wherein said vending machine face further includes a frame, said access panel being provided in said frame.

19. The vending machine face as recited in claim 15, wherein said frame includes an elongated aperture therein, said access panel being pivotally mounted to said frame for movement from a closed position where said access panel blocks said aperture, to an open position where said access panel does not block said aperture.

20. The vending machine face as recited in claim 17, wherein said locking mechanism includes a plurality of spaced-apart fasteners interconnecting said access panel to said vending machine face.

21. The vending machine face of claim 17, further comprising a locking mechanism for locking the access panel in the closed position.

22. A vending machine including a vending machine face having at least one graphics piece therein, the vending machine face comprising:

a movable door that provides access to an interior of the vending machine, the door having a first surface facing the interior of the vending machine, an opposite second surface facing outwardly from the vending machine, and four outwardly-facing peripheral surfaces surrounding the first and second surfaces; and an access panel provided in at least one of the second surface and four outwardly- facing peripheral surfaces, the access panel being movable, relative to the door, from a closed position prohibiting access to the graphics piece, to an open position permitting access to the graphics piece for removal thereof.

23. The vending machine of claim 22, further comprising a locking mechanism for locking the access panel in the closed position.

24. A vending machine as recited in claim 23, wherein the door is movable between an open and a closed position, said door including a lock for locking said door in said closed position.

25. The vending machine as recited in claim 24, wherein said vending machine includes a money box which is not accessible when said door is in said closed position.

26. The vending machine as recited in claim 24, wherein said locking mechanism is accessible when said door is in said closed position.

27. A vending machine face having at least one graphics piece therein, said vending machine face comprising:

a movable door including at least one of a transaction area and a product delivery port;

an access panel provided in said vending machine face, said access panel being movable, relative to the door, from a closed position prohibiting access to such a graphics piece, to an open position permitting access to such a graphics piece for removal thereof;

a plurality of trim pieces the access panel including one of the plurality of trim pieces; and a second access panel including another of the plurality of trim pieces.

28. The vending machine of claim 27, further comprising at least one of a first locking mechanism for locking the access panel in the closed position and a second locking mechanism for locking the second access panel in the closed position.

* * * * *

UNITED STATES PATENT AND TRADEMARK OFFICE

CERTIFICATE OF CORRECTION

PATENT NO. : 6,230,426 B1
DATED : May 15, 2001
INVENTOR(S) : Bassem Hassan Fakhoury et al.

It is certified that error appears in the above-identified patent and that said Letters Patent is hereby corrected as shown below:

Title page,
Item [75], Inventors,
Line 1, "Bassam" should read -- Bassem --.

Item [74], Attorney, Agent, or Firm
Line 2, "L.L.P" should read -- L.L.P. --.

Column 10, claim 11,
Line 63, "thereof," should read -- thereof; --.

Column 11, claim 17,
Line 56, "cabinet," should read -- cabinet; --.

Column 12, claim 19,
Line 4, "claim 15" should read -- claim 18 --.

Column 12, claim 22,
Line 28, "outwardly- facing" should read -- outwardly-facing --.

Column 12, claim 27,
Line 55, after "trim pieces", insert a comma.

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,230,426 B1
DATED : May 15, 2001
INVENTOR(S) : Bassem Hassan Fakhoury et al.

It is certified that error appears in the above-identified patent and that said Letters Patent is hereby corrected as shown below:

Title page,
Item [75], Inventors, "Bassam" should read -- Bassem --.

Item [74], *Attorney, Agent*, or *Firm* "L.L.P" should read -- L.L.P. --.

Column 10,
Line 35, "potion" should read -- portion --.
Line 63, "thereof," should read -- thereof; --.

Column 11,
Line 56, "cabinet," should read -- cabinet; --.

Column 12,
Line 4, "claim 15" should read -- claim 18 --.
Line 28, "outwardly- facing" should read -- outwardly-facing --.
Line 55, after "trim pieces", insert a comma.

Signed and Sealed this

Fourteenth Day of May, 2002

*Attest:*

*Attesting Officer*

JAMES E. ROGAN
*Director of the United States Patent and Trademark Office*